US005375344A

United States Patent [19]

Ruefli et al.

[11] Patent Number: 5,375,344

[45] Date of Patent: Dec. 27, 1994

[54] APPARATUS FOR REMOVING MOISTURE FROM A WET MATERIAL USING A RADIANT HEAT SOURCE

[75] Inventors: Alfred Ruefli, Sherwood Park; L. C. James Razzell, Edmonton, both of Canada

[73] Assignee: R & D Dryers Inc., Edmonton, Canada

[21] Appl. No.: 89,695

[22] Filed: Jul. 9, 1993

[51] Int. Cl.[5] ..... F26B 3/34; F26B 11/12

[52] U.S. Cl. ..... 34/269; 34/76; 34/180; 34/182; 219/445

[58] Field of Search ..... 34/179, 180, 181, 182, 34/183, 17, 39, 40, 1 W, 269, 266, 267, 76; 219/445, 446

[56] References Cited

U.S. PATENT DOCUMENTS 1,759,955 5/1930 Quinn ..... 34/39 X 5,220,733 6/1993 Bothe et al. ..... 34/180 X

*Primary Examiner*—Henry A. Bennett

*Attorney, Agent, or Firm*—Rodman & Rodman

[57] ABSTRACT

An improved method and apparatus for removing moisture from a wet material. The apparatus is of the type having: an elongated trough having at least one level for containing the material, the trough having an upward open portion, a downward closed portion, a feed end for receiving the material and a delivery end for discharge of the material; means, associated with the trough, for conveying the material contained in the trough from the feed end to the delivery end; a heat plate for generating a radiant heat mounted along substantially the entire length of the open portion of each level of the trough such that the material conveyed in each level of the trough is exposed to the radiant heat in order that a portion of the moisture in the material may be evaporated; means, operatively connected to the heat plate, for controlling the temperature of the heat plate in order that the radiant heat is generated in a controlled manner such that a desired temperature of the material throughout each level of the trough may be maintained; and means, associated with the trough, for collecting the moisture evaporated by the radiant heat. The heat plate is preferably electrically heated. The method for removing moisture from the wet material is performed by using the apparatus.

16 Claims, 4 Drawing Sheets

APPARATUS FOR REMOVING MOISTURE FROM A WET MATERIAL USING A RADIANT HEAT SOURCE

TECHNICAL FIELD

The present invention relates to a method and an apparatus, including at least one self-contained processing tier, for removing moisture from a wet particulate material.

BACKGROUND ART

Many types of wet particulate materials or industrials products must have their moisture content reduced in order to render the materials commercially useful or capable of economic transportation and storage, or to prevent their deterioration. The type of wet materials which may require such drying include industrial waste or sewage sludge, pulp sludge, various slurries, grains, cereals, organic and inorganic fibres and pulps and chemical waste. Given increasingly stringent environmental standards and regulations, the drying, or removal of a portion of the moisture, of the wet materials is preferably accomplished in a relatively environmentally safe manner by reducing the pollutants released to the environment as a result of the drying process.

In the case of grain or cereal crops, rain or damp weather at harvest time may prevent natural drying in the field and result in deterioration and possible rotting of the crops. The commercial value of the crop may be preserved by quickly drying the crop to allow for its safe transportation and storage. However, the crop must be dried without damaging the grain or cereal. In addition, the moisture removed from the crop is preferably recycled and returned to the environment without the addition of any harmful pollutants to the environment.

Similar drying processes may also be required for the byproducts or wastes produced by industrial processes. These industrial byproducts often contain chemicals or other harmful materials which tend to pollute the environment, but which must be disposed of in some fashion. Such industrial byproducts are often in the form of fine inorganic and organic particles suspended or otherwise diffused in water and are known as sludges or slurries. Examples of sources of such sludges or slurries include pulp and paper mills, sewage treatment plants, chemical plants and other food processing or industrial operations. In addition to disposal problems, these industrial byproducts are often difficult and costly to handle and transport due to their high liquid or moisture content. Thus dehydration of these materials, by removing the excess moisture, is required. Preferably, the dehydration is conducted in a manner rendering both the removed moisture and the dehydrated material relatively environmentally friendly as compared to the initial industrial byproduct. In addition, in many cases, the dehydration of the industrial byproducts will sterilize the harmful or toxic substances contained in them and render them commercially valuable as, for example, a fertilizer.

Drying of these types of wet materials, and removal of their excess moisture, may be accomplished mechanically through the use of belt presses, centrifuges, filters and holding ponds for settling and separation over time. Mechanical drying typically removes only a limited portion of the moisture content and does not affect any pollutants contained in the resulting processed materials.

Another method previously utilized for drying these wet materials involves indirect heating using furnaces, kilns, burners, ovens, and the like. Indirect heating typically involves blowing hot air produced by the furnace, or other indirect heating apparatus, across the wet material. Although the volume of moisture contained in the wet material is reduced, many of the pollutants are released into the vapour produced by the heat which may in turn become mixed with the flue gases and released to the atmosphere. In addition, the furnace is typically heated by means of combustion resulting in the further release of polluted flue gases into the atmosphere. Finally, the temperature of the wet material during the drying process is often difficult to control and may result in burning of the dehydrated material, rendering it of limited commercial value. As a result, the dehydrated material may need to be incinerated.

A further method for drying the wet materials involves using a combination of radiant heat and hot air produced through the combustion of heating oil or gas. Flame burners are used to produce the radiant heat. The exhaust gases from the flame burners produce the hot air for the indirect heating. The hot air is not in direct contact with the material, but rather, is blown through a casing in a trough conveying the material and through the hollow axles of auger shafts moving the material through the trough. One example showing this combination of radiant heat and combustion gases to dry sewage sludge is shown in PCT Application No. PCT/CA90/00074 to Schmidt et. al. published Sep. 7, 1990.

Several disadvantages may arise from applying an indirect heat to the wet material through the circulation of combustion exhaust gases. The temperature of the material through the entire drying process and apparatus may be difficult to control. In particular, the temperature of the exhaust gases from the flame burners, distributed throughout the apparatus, may be constant regardless of the moisture level in the material at any particular point in the apparatus and regardless of the particular stage of dehydration of the material. It is therefore difficult to control the heat gradient as the material is dehydrated, which may result in burning. As well, difficulty in controlling the temperature of the exhaust gases may result in overheating of the apparatus and burning of the material.

The use of exhaust gases to indirectly heat the material, and attempts to better control the temperature of the exhaust gases, have resulted in relatively complicated apparatuses incorporating equipment such as: fire boxes for combustion; jacketed pipes, troughs and augers to convey the hot exhaust gases; and complicated water cooling systems involving water injection apparatus for reducing the temperature of the hot exhaust gases circulated through the drying apparatus. The use of these types of relatively complicated equipment may result in greater maintenance and repair problems.

Finally, combustion of oil and gas produces exhaust gases containing pollutants which may be harmful to the environment and which may require treatment prior to their discharge. For example, the exhaust gases may contain sulfuric acid. In addition to being a pollutant, sulfuric acid tends to corrode any surface it comes into contact with. Therefore, corrosion may become a problem within the areas of the apparatus circulating the exhaust gases, such as the jacketed pipes, troughs and augers.

There is therefore a need in the industry for a method and an apparatus for removing moisture from a wet material in a relatively environmentally safe manner, without damaging the material, by applying heat in a relatively precisely controlled manner. In addition, the apparatus should preferably be relatively simple to construct and maintain as compared to previously known drying apparatuses.

DISCLOSURE OF INVENTION

The present invention relates to a drying method and an apparatus for removing moisture from a wet material. The material is exposed to a controlled radiant heat while being conveyed through a trough. Means are provided for controlling the temperature of the radiant heat at any particular point along the trough in order that a desired temperature of the material may be maintained.

In an aspect of the invention in its apparatus form, the invention comprises an apparatus for removing moisture from a wet material comprising an elongated trough having at least one level for containing the material. The trough has an upward open portion, a downward closed portion, a feed end for receiving the material and a delivery end for discharge of the material. Means are associated with the trough for conveying the material from the feed end to the delivery end. A heat plate for generating a radiant heat is mounted along substantially the entire length of the open portion of each level of the trough such that the material conveyed in each level is exposed to the radiant heat in order that a portion of the moisture in the material may be evaporated. Means are operatively connected to the heat plate for controlling the temperature of the heat plate in order that the radiant heat is generated in a controlled manner such that a desired temperature of the material throughout each level of the trough may be maintained. Further, means are associated with the trough for collecting the moisture evaporated by the radiant heat.

In this aspect of the invention, the heat plate may be electrically heated and may be comprised of greater than one panel. Each panel is operatively connected to the controlling means such that the temperature of each panel may be independently controlled by the controlling means in order to facilitate the maintenance of the desired temperature of the material throughout the length of each level of the trough. The conveying means may be comprised of a spiral auger rotatably mounted within each level of the trough and means for rotating the auger such that the material is conveyed through each level of the trough from the feed end to the delivery end. The auger may be formed from a continuous ribbon of stainless spring steel. The rotating means may be comprised of a drive motor operatively connected to the auger. The rotating means may further be comprised of a control sensor associated with the auger for monitoring the rotation of the auger.

Further, in this aspect, the trough is preferably comprised of at least two successive levels connected in series such that material from an end of one level is transferred to an end of the adjacent level in order that the material is conveyed through the length of the trough. All of the successive levels are preferably substantially similar. The trough is preferably comprised of between 2 to 6 levels. Preferably 80 to 85 percent of the volume of the trough on cross-section is filled with the material. The collecting means may be comprised of a chamber mounted along substantially the entire length of the closed portion of each level of the trough. The apparatus may further comprise means for delivering the material to the feed end of the trough. The delivering means may be comprised of a feeder tank having an opening adjacent to the feed end of the trough for containing the material to be delivered to the trough and means for feeding the material from the feeder tank into the trough. The feeding means may be a pair of rollers mounted adjacent to the opening in the feeder tank for feeding the material from the feeder tank at a controlled rate into the trough. The apparatus may further be comprised of means for supplying the material to the feeder tank and means for connecting a condenser to the collecting means for condensing the collected moisture. The material preferably contains a maximum of 85 percent moisture. Preferably at least two troughs are mounted adjacent to each other in a manner such that each trough is parallel to each other trough in the apparatus. Each trough may be substantially similar to each other trough.

In an aspect of the invention in its method form, the invention is comprised of a method for removing moisture from a wet material comprising the steps of: delivering the material to an elongated trough having at least one level, an upward open portion, a downward closed portion, a feed end for receiving the material and a delivery end for discharge of the material; conveying the material in the trough from the feed end to the delivery end; applying a radiant heat to the material along substantially the entire length of the open portion of each level of the trough such that a portion of the moisture in the material is evaporated by the heat as the material is conveyed in the trough; controlling the temperature of the radiant heat applied to the material in order to maintain a desired temperature of the material throughout each level of the trough; and discharging the material from the delivery end of the trough and collecting the moisture evaporated by the radiant heat.

In this aspect of the invention in its method form, the applying step may be performed by electrically heating a heat plate mounted along substantially the entire length of the open portion of each level of the trough. The heat plate may be comprised of greater than one panel and the controlling step may be performed by independently controlling the temperature of each panel in order to facilitate the maintenance of the desired temperature of the material throughout the length of each level of the trough. The conveying step may be performed by rotating a spiral auger within each level of the trough such that the material is conveyed through each level of the trough from the feed end to the delivery end. The spiral auger may be rotated by a drive motor operatively connected to the auger. The conveying step may further include monitoring the rotation of the auger throughout the conveying step. The monitoring step may be performed by a control sensor associated with the auger.

Further, in this aspect of the invention, the conveying step may be performed through at least two successive levels of the trough connected in series such that the material from an end of one level is transferred to an end of the adjacent level in order that the material is conveyed through the length of the trough. All of the successive levels are preferably substantially similar. The conveying step may be performed through between 2 to 6 successive levels of the trough. About 80 to 85 percent of the volume of the trough on cross-section may contain the material throughout the conveying step. The collecting step may be performed by collecting the moisture evaporated by the radiant heat in a chamber mounted along substantially the entire length of the closed portion of each level of the trough. The method may be further comprised of the step of delivering the material to the feed end of the trough. In addition, the method may be further comprised of the steps of storing the material to be delivered to the trough in a feeder tank having an opening adjacent to the feed end of the trough and feeding the material from the feeder tank into the trough. The feeding step may be performed at a controlled rate by a pair of rollers mounted adjacent to the opening in the feeder tank. The method may further comprise the step of condensing the evaporated moisture collected during the collecting step. The material preferably contains a maximum of 85 percent moisture. The material may be delivered in the delivering step to at least two troughs mounted adjacent to each other in a manner such that each trough is parallel to each other trough. Each trough may be substantially similar to each other trough.

BRIEF DESCRIPTION OF DRAWINGS

Embodiments of the invention will now be described with reference to the accompanying drawings in which.

BEST MODE OF CARRYING OUT INVENTION

This invention is directed at an apparatus for drying a wet material which is designed to be self-contained such that it may be used in either a fixed location or as a portable unit. However, the invention is preferably included in a portable unit of the same size and configuration as a standard 45 foot shipping container which can typically be handled by transportation equipment worldwide.

The method and apparatus are directed at drying a wet material. Drying or processing of the material involves the removal of a portion of the moisture contained in the material. The wet material to be dried or processed by the within invention is comprised of a particulate matter suspended or otherwise diffused within a liquid, such as a slurry. The wet material may contain any amount or percentage of liquid or moisture. However, the wet material preferably contains 85 percent liquid or moisture. The liquid or moisture is water such that steam is formed by exposure of the wet material to a radiant heat. The particulate matter may be materials such as grain, cereals, chemical and mineral matter, organic and inorganic fibres and waste products.

Figure 1:
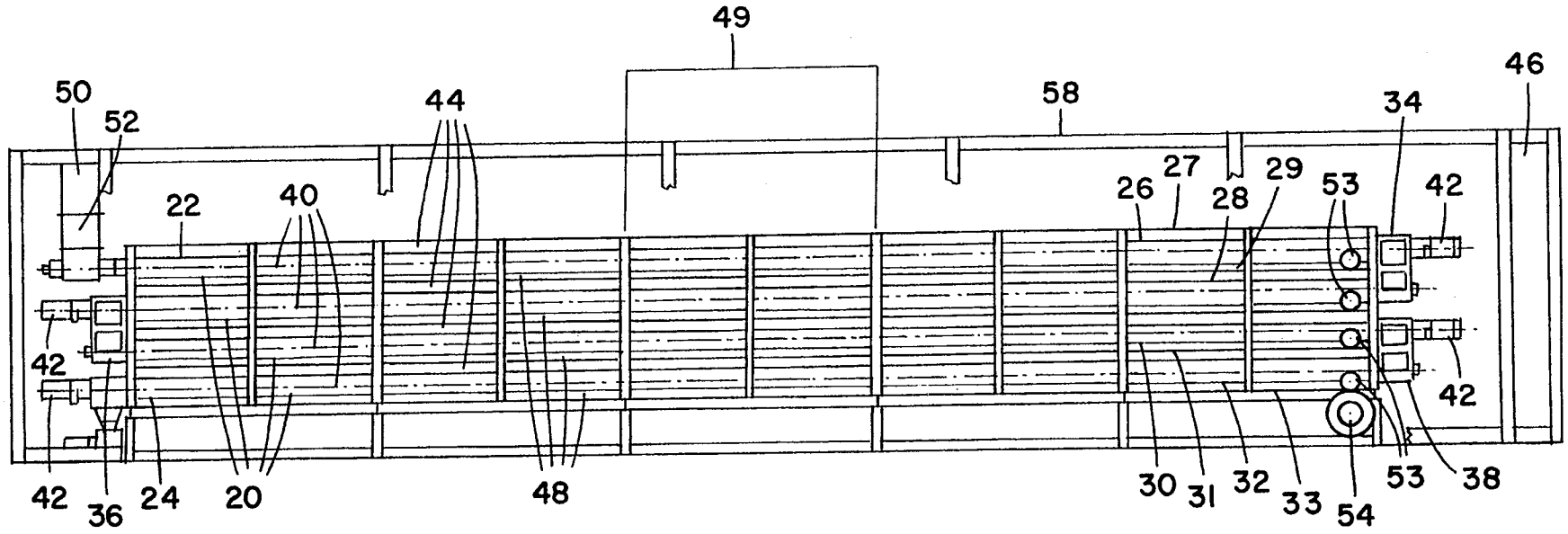
FIG. 1 is a schematic side view of the apparatus including four processing tiers.

Referring to FIG. 1, the invention in its apparatus form preferably includes ten troughs (20) for containing the wet material, but may contain more or fewer troughs. Each trough (20) is comprised of an elongated receptacle having an upper open portion and a lower closed portion such that each trough (20) forms a channel for conveying the wet material. In order to contain the material within each trough (20), each trough (20) is preferably located in a substantially horizontal plane with the open portion facing upwards. Each trough (20) has a feed end (22) for receiving the wet material and a delivery end (24) for discharge of the material after having had a portion of the moisture removed therefrom. Each trough (20) is preferably constructed from stainless steel.

The troughs are mounted adjacent to each other in a manner such that each trough is parallel to each other trough in the apparatus. The troughs are preferably arranged adjacent to each other in a substantially horizontally plane, and are substantially similar in shape and size from the feed end (22) to the delivery end (24) of each trough (20). Thus, wet material may be delivered to the feed ends of each trough (20) in order that a greater amount of material may be processed at one time.

In addition, in its preferred embodiment, each trough (20) is comprised of greater than one level and typically contains between 2 to 6 levels, preferably four, as shown in FIG. 1 (26, 28, 30, 32). The levels (26, 28, 30, 32) are connected in series so that the material is conveyed through each successive level in turn. In this manner, the material is conveyed continuously through the length of each trough (20) from the feed end (22) to the delivery end (24).

Preferably, each trough (20) in the apparatus contains the same number and size of levels as each other trough. In the preferred embodiment, the levels (26, 28, 30, 32) are stacked in a substantially vertical plane upon each other in a parallel arrangement in order that the entire trough (20) becomes more compact and requires comparatively less space, thus rendering the apparatus more space efficient and transportable. The material is conveyed in an opposite direction in each successive level (26, 28, 30, 32). For example, in FIG. 1, the material would be conveyed from left to right in level 1 (26), then right to left in level 2 (28), left to right in level 3 (30), right to left in level 4 (32) and so on for all levels.

Figure 2:
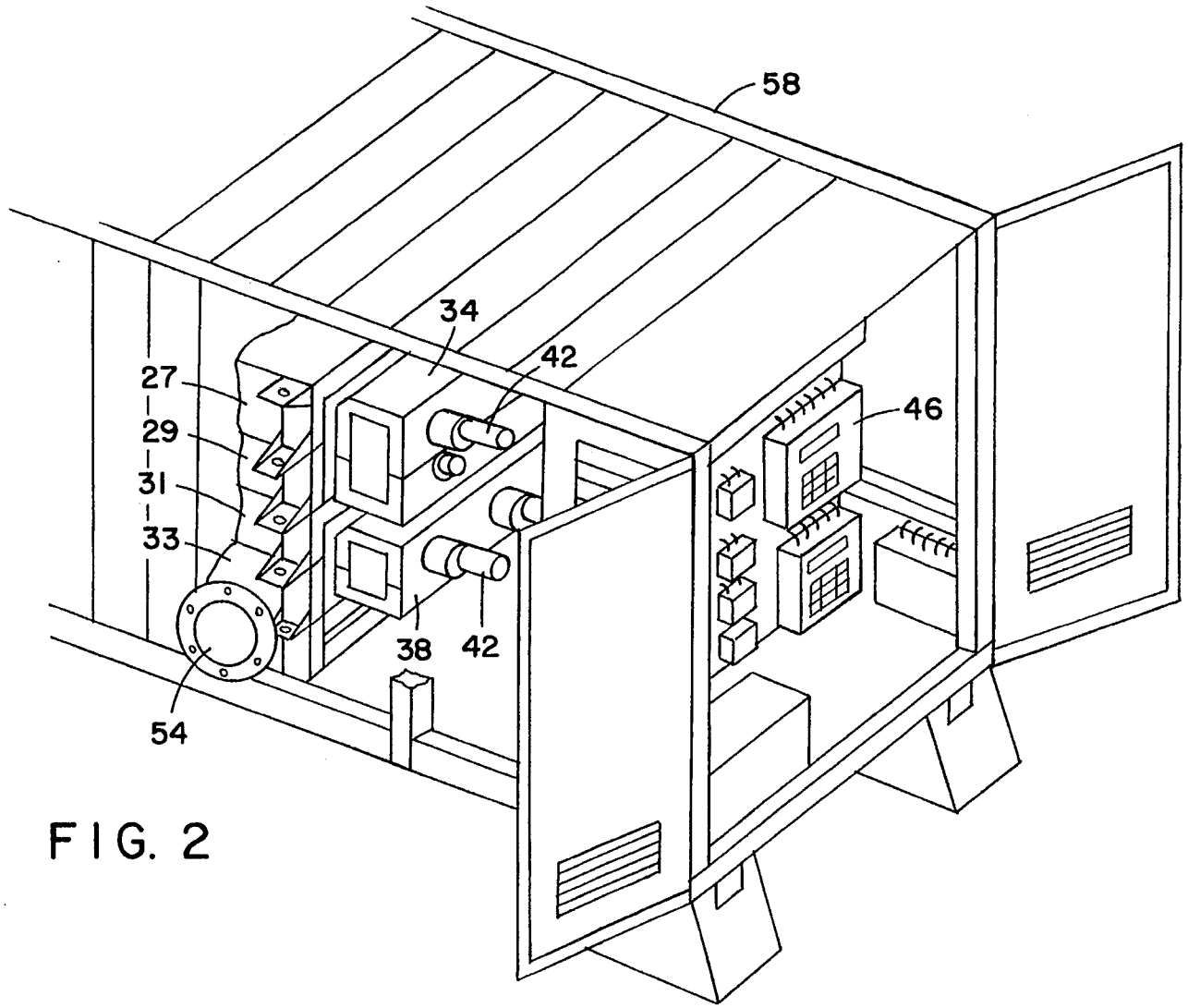
FIG. 2 is a pictorial side view of the apparatus in a preferred embodiment housed in a first container, having a cutaway portion, and including an adjoining control room for the apparatus.

Referring to FIGS. 1 and 2, in the preferred embodiment, the material is transferred between the levels (26, 28, 30, 32) of each trough (20) by a transfer box (34) located between levels 1 and 2 (26, 28), a transfer box (36) located between levels 2 and 3 (28, 30), a transfer box (38) located between levels 3 and 4 (30, 32) and so on. Each transfer box (34, 36, 38) is located at the ends of the particulars levels between which the material is being transferred and allows the material to free fall by gravitational forces from the upper level of each trough (20) to the lower level of each trough (20). Thus, for example, the material is conveyed from the feed end (22) of each trough (20) through level 1 (26), is dropped through the transfer box (34) onto each trough (20) in level 2 (28) for conveyance through level 2 (28). This process is repeated through each successive level to the delivery end (24) of each trough (20).

In the preferred embodiment, the apparatus includes at least one independent, self-contained, drying or processing tier as shown in FIG. 1. In the preferred embodiment including four tiers (27, 29, 31, 33), each tier contains: a specific level of each trough (20) contained in the apparatus, each having an auger (40) and a drive motor (42) for the auger (40); a heat plate (44) and a controlling system (not shown) for the heat plate (44); all mounted over a moisture collecting chamber (48). Each processing tier (27, 29, 31, 33) is constructed of stainless steel and is independently removable for servicing. As each tier is virtually identical, any tier may be used as a replacement tier for any other tier in the event that repairs should be required.

As stated, where the apparatus contains more than one trough (20), a specific level of every trough will be contained in a distinct processing tier. In other words, for example, the first level (26) of every trough will be contained in the first processing tier (27), the second level (28) of every trough will be contained in the second processing tier (29), and so on.

Each tier may be further divided into a number of partial tiers (49) which together comprise the complete tier. The partial tiers (49) are mounted in the apparatus and connected together in a manner using a quick release connection which allows for fast and easy maintenance and replacement of any portion of the tier or its components.

As stated, each tier (27, 29, 31, 33) contains a specific level of every trough (20) and each level (26, 28, 30, 32) contains an auger (40) for conveying the material therethrough such that the material is continuously conveyed from the feed end (22) to the delivery end (24) of the trough (20). Each auger (40) is a spiral auger which is rotatably mounted within each level of each trough (20). Each auger (40) in each level (26, 28, 30, 32) is preferably made of one continuous ribbon of stainless spring steel, without welds, in order that the auger (40) may better withstand the continual flexing of the auger (40) at the high temperatures created during the operation of the within invention. Spiral augers are commercially available in various diameters and pitches, which may be chosen to best transport the particular material to be processed by the apparatus.

The auger (40) is rotated within each trough (20) to convey the material by an auger drive motor (42). A drive motor (42) is operatively connected to an end of each auger (40). The drive motor (42) is preferably a conventional variable speed electric motor. A separate or independent drive motor (42) is preferably attached to the auger (40) on each level (26, 28, 30,32) in order that the rotation speed of the auger (40) on any level may be independently monitored and controlled. It may be desirable to adjust the rotation speeds for different processing times on each level to suit the particular type of material or speed of vaporization of the material an the particular level.

In addition, a control sensor associated with each auger (40) reads the rotation of the auger (40) and conveys the information to a single master control board (46) which monitors and controls the entire apparatus and process performed thereby. The control sensor is preferably an induction control sensor which indicates when the auger (40) in any level stops turning or there is an uneven rotation speed of the auger (40) in order that the operator may shut off the drive motor (42). Should an auger (40) break in operation, the drive motor (42) must be shut down to prevent damage to the apparatus. The shutdown operation also requires that the augers in the processing tiers above the damaged tier be shut off. The augers in the lower tiers may be operated in order that the operator may complete his shift and schedule the shutdown of the entire apparatus in an orderly fashion for repair of the broken auger.

Figure 3:
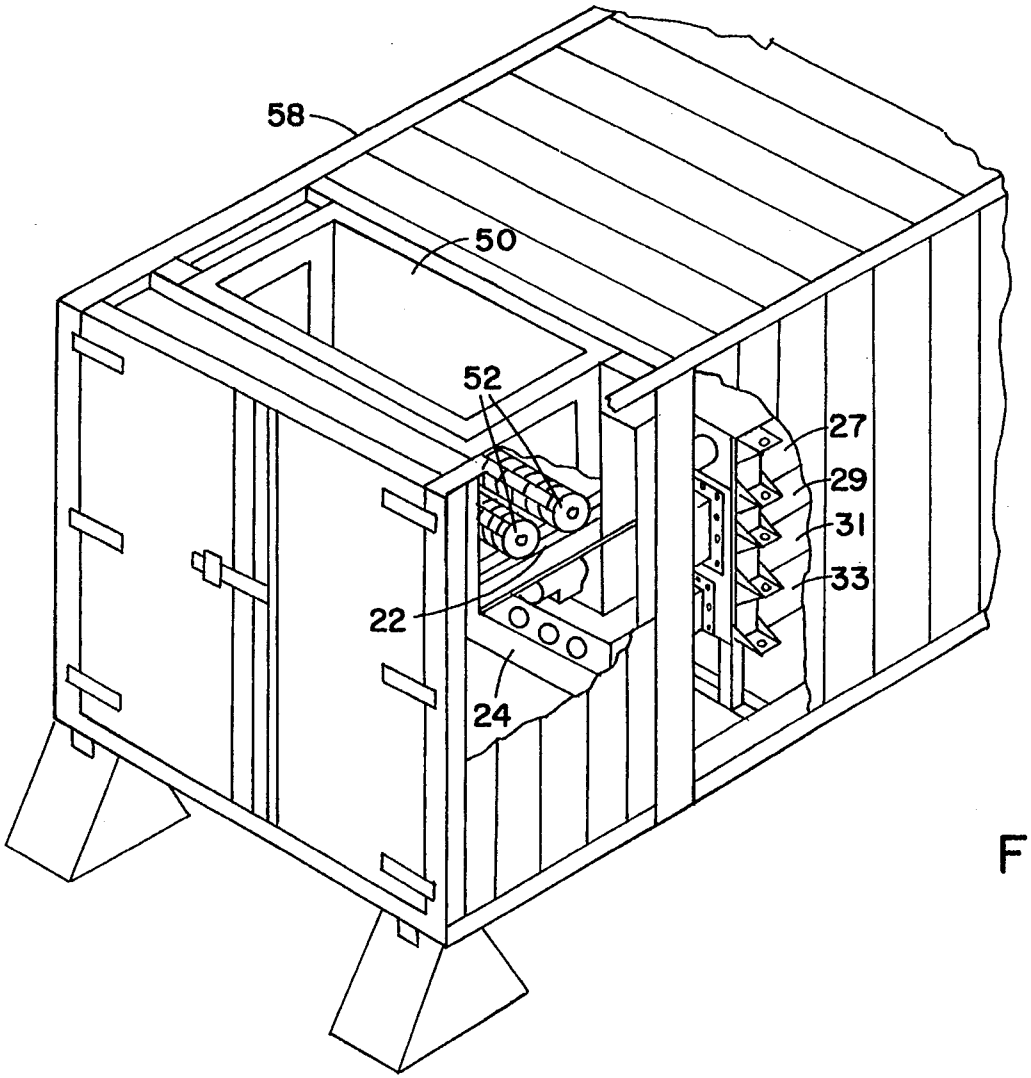
FIG. 3 is a pictorial side view of the apparatus in its preferred embodiment housed in the first container, having a cutaway portion, and showing the feeder box and anti-bridging rollers in greater detail.

In the preferred embodiment, the apparatus is further comprised of means for delivering the wet material to the feed end (22) of each trough (20) for conveyance by the augers (40). Preferably, the material is delivered on a continuous basis. Referring to FIGS. 1 and 3, the delivery is performed by a feeder tank (50) and anti-bridging rollers (52). The feeder tank (50) has an opening adjacent to the feed end (24) of each trough (20) and acts as a container for the material until such time that the material is processed. As stated, the wet material to be dried or processed is delivered to the feeder tank (50). Delivery to the feeder tank (50) may occur by use of a conventional conveyer system which terminates in an oscillating spout (not shown). The spout spreads the material over the width of the feeder tank (50) in order to obtain a fairly even distribution of the material in the feeder tank (50). The material in the feeder tank (50) is then fed from the feeder tank (50) by the antibridging rollers (52) into the feed end (22) on level 1 (26) of each trough (20).

A pair of anti-bridging rollers (52) are mounted adjacent to the opening in the feeder tank (50) between the feeder tank (50) and each trough (20). The antibridging rollers (52) are controlled to maintain an appropriate feed rate and pressure on the wet material as it enters the feed end (22). The appropriate feed rate and pressure will vary depending upon the type of wet material being processed, the percentage moisture of the material, the temperature of the heat plate (44) and the desired processing temperature of the material. The feed rate and the pressure are important as they affect the production of the apparatus and the quality of the processed material. In the initial filling of the feed end (22) of each trough (20), the material should be fed at a rate such that about 80 to 85 percent of each trough (20) on cross-section is filled with the material in order to ensure a maximum heat sink or transfer of heat through the material as it is conveyed in each trough (20). Commercially available level indicators may be used to monitor the material level in each trough (20). The level of the material may be adjusted accordingly by varying, amongst other things, the feed rate and the auger (40) speed. Preferably, the control means for the feeder tank (50) and the anti-bridging rollers (52) are connected to the single master control board (46) for the entire apparatus.

Referring to FIG. 1, a heat plate (44) is located in each processing tier (27, 29, 31, 33). Each heat plate (44) generates a radiant heat for directly heating the material conveyed beneath it by each successive level of each trough (20). The heat plate (44) must have the capacity to generate sufficient heat for the specific needs of the material to be processed. Typically, the temperature of the heat plate (44) will be reduced as the material is conveyed along each trough (20) since the material to be processed will have a lower heat absorption capacity as the moisture is evaporated. Heating of the material does not require the circulation of hot gases within the processing tiers (27, 29, 31, 33). In addition, in the preferred embodiment, the heat plate (44) is electrically heated such that no combustion gases are produced by heating of the heat plate (44).

In the preferred embodiment, a single heat plate (44) is mounted in each tier (27, 29, 31, 33) above the open portion of each trough (20) along substantially the entire length of each trough (20). In other words, referring to FIG. 1, in the preferred embodiment having four tiers (27, 29, 31, 33), there are four heat plates (44). The material conveyed through each trough (20) in each tier (27, 29, 31, 33) is exposed to the heat generated by the heat plate (44) in that tier in order that the material is processed by evaporating a portion of the moisture in the material and converting it to steam.

Each heat plate (44) is operatively connected to a control system for controlling the temperature of each heat plate (44) in order that the radiant heat is generated in a controlled manner such that a desired temperature of the material may be maintained throughout each level (26, 28, 30, 32) of each trough (20). The desired temperature of the material will vary depending upon, amongst other things, the material being processed, the intended end product, the moisture content of the material and the speed at which the material is conveyed by the auger (40). It is preferred that the control system be linked to the single master control board (46) for central monitoring and regulation.

The within invention combines a relatively environmentally friendly heating source, without the generation of combustion and exhaust gases, with relatively greater temperature control than previously known apparatuses. Temperature control is necessary to facilitate the prevention of any unwanted burning of the material and to inhibit the potential breakdown of some materials into unwanted, environmentally unfriendly compounds. In previously known apparatuses, these compounds were sometimes vented through the burners supplying the heat source and exited to the atmosphere with the exhaust gases. The within invention provides an environmentally friendly heating source and relatively greater temperature control by use of the electrically heated radiant heat plate described above.

In addition, to provide greater temperature control, each heat plate (44) is preferably comprised of a series of sealed electric panels mounted adjacent to each other in a floating mount above the troughs (20) which allows for expansion. The panels are sealed in order to inhibit the passing of any evaporated moisture through the heat plate (44) to lie above it. Each panel has a variable output setting and is operatively connected to the temperature control system such that the temperature of each panel may be independently monitored and controlled.. In this manner, the temperature of the material may be more easily maintained at the desired temperature throughout the length of each trough (20) in each level (26, 28, 30, 32) as the moisture content of the material decreases from the feed end (22) to the delivery end (24) of each trough (20). As stated, the temperature of each heat plate (44) is typically reduced as the material is conveyed along each trough (20) since the material will have a lower heat absorption capacity as the moisture is evaporated from it.

In the preferred embodiment, each heat plate (44) is comprised of 40 individual rectangular panels which can be independently temperature controlled. Such panels are of a conventional type. The 40 panels comprising the heat plate (44) are mounted above the troughs (20) in a manner so that the heat plate is 20 panels in length, along the lengths of the troughs (20) and 2 panels in width.

The control system monitors and regulates the temperature of the panels by taking temperature readings of the material being processed and the moisture content of the material as it exits each level (26, 28, 30, 32) of each trough (20). In addition, the panels allow for different sections or portions of each heat plate (44) to be turned on or off at different phases of the process, such as during startup or shutdown of the apparatus, in order to assist in avoiding overheating of the system or unnecessary energy use. Preferably, a plurality of control loops comprising the temperature control system relay the pertinent data to the single master control board (46) for the apparatus. The temperature control system is set up to regulate each panel temperature for the specific type of material being processed as the desired temperature will vary from one material to the next.

The moisture evaporated by the radiant heat is collected by collecting means, preferably a chamber, in each processing tier (27, 29, 31, 33). Each processing tier (27, 29, 31, 33) contains a single chamber (48). Each chamber (48) is preferably a stainless steel chamber (48) mounted along substantially the entire length of the closed portion of every trough (20) in that tier (27, 29, 31, 33). Although each chamber (48) is located beneath the troughs (20) in that tier (27, 29, 31, 33), it is mounted in a manner to allow the evaporated moisture from each processing tier (27, 29, 31, 33) to flow freely into the chamber (48) located in that particular tier. The evaporated moisture is drawn into each chamber (48) by a slight vacuum in each chamber (48). Once the evaporated moisture or steam from the material, created by the radiant heat, is drawn into each chamber (48), it is evacuated from each chamber (48), by stainless steel conduits (53) which vent into a single steam duct (54). The steam duct (54) evacuates moisture from each chamber (48) in each processing tier (27, 29, 31, 33) and is connected to a condenser (56), preferably a spray condenser, for condensing the collected moisture.

Figure 4:
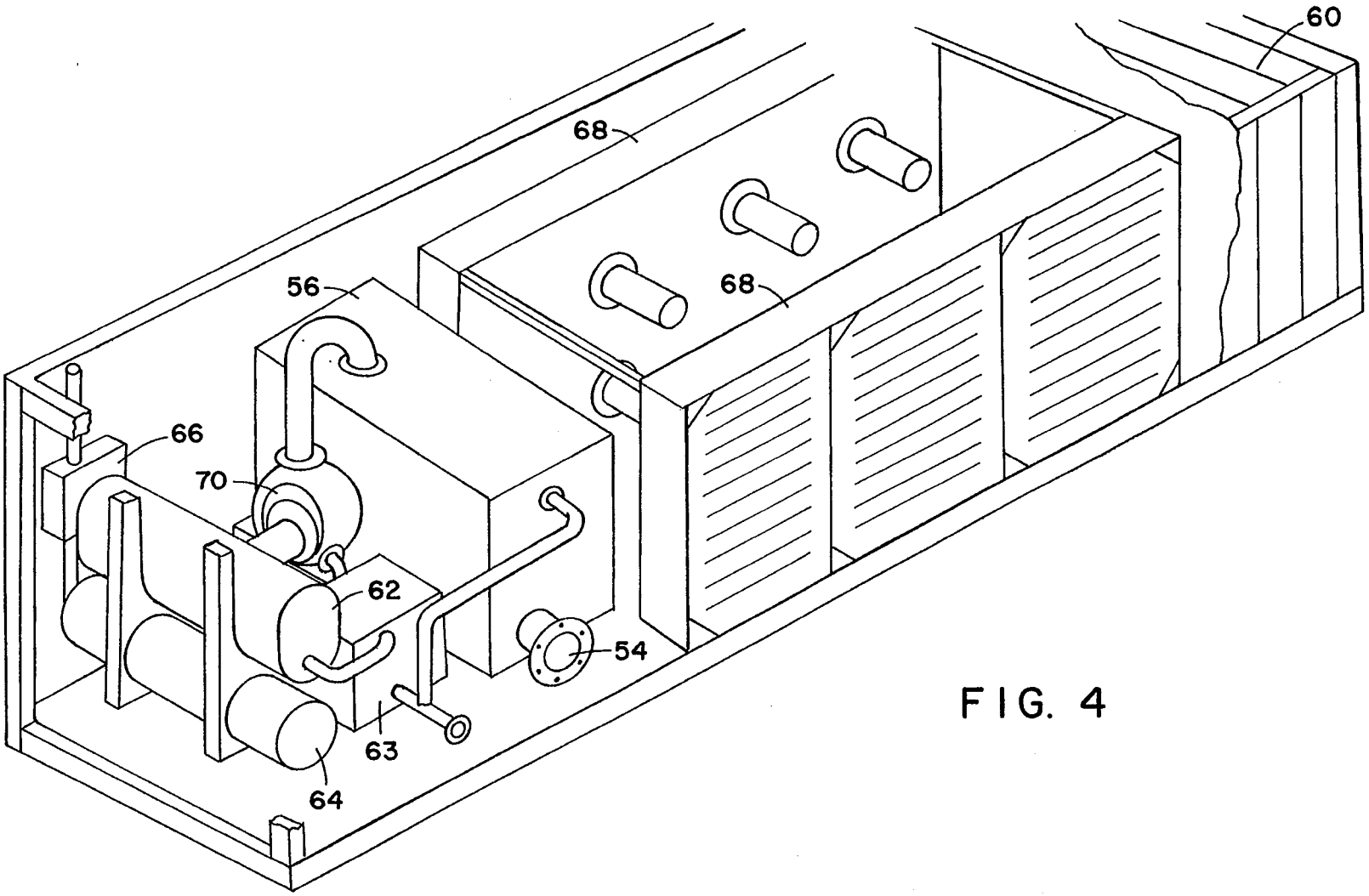
FIG. 4 is a pictorial side view of a second container, having a cutaway portion, including a condenser system for connection to the first container shown in FIGS. 1 through 3.

As shown in FIGS. 1 through 3, all of the above described processing tiers (27, 29, 31, 33) are preferably housed or contained in a first container (58). The first container (58) is linked to a second container (60), shown in FIG. 4, by the steam duct (54). The second container (60) holds: the condenser (56); a separator tank (62); a filter (63); a pressure tank (64) for the off gases; a plasma arc (66) to destroy the off gases; a glycol cooling system (68) which will hold the temperature of the spray water for the condenser (56) in the range of 40 to A45 degrees Celsius for maximum operating efficiency; and a compressor (70). All of the equipment is of a conventional type, chosen to meet the specific needs of the invention.

The collected moisture is conducted from the first container (58) to the second container (60) via the steam duct (54). The moisture is then conducted to the condenser (56) where the moisture is converted to condensate. Next, the condensate is pumped from the condenser (56) by the compressor (70) into the separator tank (62). The separator tank (62) removes the oils and greases from the condensate. The remaining condensate is filtered by the filter (63) before being returned to the environment, as environmentally friendly water, or recirculated into the condenser (56). Non-condensable or "off" gases are removed from the condenser (56) and pumped by the compressor (70) into the pressure tank (64). From the pressure tank (64), the off gases are fed into a plasma arc (66) to destroy any toxins in the gas stream.

The embodiments of the invention in which an exclusive privilege or property is claimed are defined as follows:

1. An apparatus for removing moisture from a wet material comprising:

(a) an elongated trough for containing the material having at least two successive levels connected in series, the trough having an upward open portion, a downward closed portion, a feed end for receiving the material and a delivery end for discharge of the material;

(b) means, associated with the trough, for conveying the material contained in the trough from the feed end to the delivery end through each successive level of the trough;

(c) an electrically heated heat plate, for generating a radiant heat, comprising a plurality of panels mounted along substantially the entire length of the open portion of each level of the trough such that the material conveyed in each level of the trough is exposed to the radiant heat in order that a portion of the moisture in the material may be evaporated;

(d) means, operatively connected to the heat plate, for independently controlling the temperature of each panel such that the; radiant heat generated by each panel may be adjusted along the length of each level of the trough in order to maintain a desired temperature of the material throughout each level of the trough; and (e) means, associated with the trough, for collecting the moisture evaporated by the radiant heat.

2. The apparatus as claimed in claim 1 wherein the conveying means are comprised of a spiral auger rotatably mounted within each level of the trough and means for rotating the auger such that the material is conveyed through each level of the trough from the feed end to the delivery end.

3. The apparatus as claimed in claim 1 wherein the collecting means are comprised of a chamber mounted along substantially the entire length of the closed portion of each level of the trough.

4. The apparatus as claimed in claim 1 further comprising means for delivering the material to the feed end of the trough.

5. The apparatus as claimed in claim 4 wherein the delivering means are comprised of a feeder tank having an opening adjacent to the feed end of the trough for containing the material to be delivered to the trough, and means for feeding the material from the feeder tank into the trough.

6. The apparatus as claimed in claim 5 further comprising means for supplying the material to the feeder tank.

7. The apparatus as claimed in claim 1 wherein at least two troughs are mounted adjacent to each other in a manner such that each trough is parallel to each other trough in the apparatus.

8. A method for removing moisture from a wet material comprising the steps of:

(a) delivering the material to an elongated trough having an upward open portion, a downward closed portion, a feed end for receiving the material, a delivery end for discharge of the material, and at least two successive levels connected in series;

(b) conveying the material in the trough from the feed end to the delivery end through each successive level such that the material from an end of one level is transferred to an end of the adjacent level in order that the material is conveyed through the length of the trough;

(c) electrically heating a heat plate having a plurality of panels mounted along substantially the entire length of the open portion of each level of the trough in order to apply a radiant heat to the material such that a portion of the moisture in the material is evaporated by the heat as the material is conveyed in the trough;

(d) independently controlling the temperature of each panel of the heat plate such that the radiant heat generated by each panel may be adjusted along the length of each level of the trough in order to maintain a desired temperature of the material throughout each level of the trough; and (e) discharging the material from the delivery end of the trough and collecting the moisture evaporated by the radiant heat.

9. The method as claimed in claim 8 wherein the conveying step is performed by rotating a spiral auger within each level of the trough such that the material is conveyed through each level of the trough from the feed end to the delivery end.

10. The method as claimed in claim 9 wherein the conveying step is further comprised of monitoring the rotation of the auger throughout the conveying step.

11. The method as claimed in claim 10 wherein the monitoring step is performed by a control sensor associated with the auger.

12. The method as claimed in claim 8 wherein the collecting step is performed by collecting the moisture evaporated by the radiant heat in a chamber mounted along substantially the entire length of the closed portion of each level of the trough.

13. The method as claimed in claim 8 further comprising the step of delivering the material to the feed end of the trough.

14. The method as claimed in claim 13 further comprising the steps of storing the material to be delivered to the trough in a feeder tank having an opening adjacent to the feed end of the trough and feeding the material from the feeder tank into the trough.

15. The apparatus as claimed in claim 1, wherein all of the levels are substantially similar.

16. The method as claimed in claim 8, wherein the material is conveyed through levels that are substantially similar.

* * * * *